US008888410B2

(12) United States Patent
Chow et al.

(10) Patent No.: US 8,888,410 B2
(45) Date of Patent: Nov. 18, 2014

(54) MODULAR HEAVY LIFT SYSTEM

(75) Inventors: Yew Yuen Chow, Houston, TX (US); Tak On Cheung, Sugarland, TX (US)

(73) Assignee: Keppel Offshore & Marine USA, Inc., Houston, TX (US)

( * ) Notice: Subject to any disclaimer, the term of this patent is extended or adjusted under 35 U.S.C. 154(b) by 721 days.

(21) Appl. No.: 12/993,309

(22) PCT Filed: Apr. 15, 2009

(86) PCT No.: PCT/SG2009/000139

§ 371 (c)(1), (2), (4) Date: Jan. 24, 2011

(87) PCT Pub. No.: WO2009/142603

PCT Pub. Date: Nov. 26, 2009

(65) Prior Publication Data

US 2011/0142590 A1 Jun. 16, 2011

(30) Foreign Application Priority Data

May 21, 2008 (SG) ..... 200803846-5

(51) Int. Cl.

| | |
|---|---|
| ***B63B 35/40*** | (2006.01) |
| ***B63B 9/06*** | (2006.01) |
| ***B66C 17/24*** | (2006.01) |
| ***E02B 17/08*** | (2006.01) |
| ***B66C 17/06*** | (2006.01) |
| ***E02B 17/02*** | (2006.01) |
| *E02B 17/00* | (2006.01) |

(52) U.S. Cl.

CPC ..... *E02B 17/021* (2013.01); *B63B 9/065* (2013.01); *E02B 2017/006* (2013.01); *B66C 17/24* (2013.01); *E02B 2017/0082* (2013.01); *E02B 2017/0047* (2013.01); *E02B 17/08* (2013.01); *B66C 17/06* (2013.01)

USPC ..... 405/203; 405/208

(58) Field of Classification Search

USPC ..... 114/265, 65 R; 405/203, 208, 209

IPC ..... B63B 35/4413

See application file for complete search history.

(56) References Cited

U.S. PATENT DOCUMENTS

| | | | | |
|---|---|---|---|---|
| 4,040,265 | A | 8/1977 | Hellerman et al. | |
| 4,139,180 | A * | 2/1979 | Itani et al. | 266/69 |
| 5,909,715 | A | 6/1999 | Menon | |
| 6,923,133 | B1 * | 8/2005 | Ross et al. | 114/45 |
| 2004/0079268 | A1 * | 4/2004 | Lambregts et al. | 114/65 R |
| 2008/0243365 | A1 * | 10/2008 | Altman et al. | 701/116 |

* cited by examiner

*Primary Examiner* — Stephen Avila

(74) *Attorney, Agent, or Firm* — Occhiuti & Rohlicek LLP

(57) ABSTRACT

A single heavy lift system is made of modular units, each of which has a pair of supporting legs carrying a transverse beam therebetween. The beam is engaged to the supporting legs through jackup units that allow the transverse beams of several modular units move in unison and thus increase lifting capacity of the system. The modular units can be formed as modular, self-propelled units, transported to the site, where the lifting task is to be performed if necessary. The system can be positioned in a dry dock or offshore.

22 Claims, 8 Drawing Sheets

MODULAR HEAVY LIFT SYSTEM

CROSS-REFERENCE TO RELATED APPLICATIONS

This application is the National Stage of International Application No. PCT/SG2009/000139, filed on Apr. 15, 2009, which claims the priority date of Singapore Application No. 200803846-5, filed on May 21, 2008 the contents of both being hereby incorporated by reference in their entirety.

BACKGROUND OF INVENTION

The present invention relates to the technical field of offshore rig construction and more particularly to the integration of the topside of a rig to its lower supporting hull structure for drilling or production operations. The topsides concerned substantially depend on the drilling and production requirements.

Two major parts of an offshore rig are: 1) a topside, which houses devices, equipment and crew accommodation unit needed for drilling or production of oil and gas; and 2) a lower hull which provides the necessary buoyancy to support the rig at an offshore site. The topside and hull of the rig are usually fabricated separately for many reasons (e.g. cost, schedule, capability and availability of fabrication facilities). The topside and the hull are transported to a mating site (usually required to be well protected from heavy traffic and weather environment) and integrated together through attachment of the topside onto the top of the hull. Traditionally, the topside integration with the hull is done either at the offshore site using lift vessel(s) or in smaller modules at a quay site.

Integration offshore is restricted by limited good weather window in which the environmental condition is mild enough to allow a safe operation and the availability of heavy lift vessels to lift the topside and place it on top of the hull. The offshore integration also requires a large logistic support including transportation barges, offshore tugs, supply vessels and anchor handling tugs (AHTs). Offshore integration is technically very challenging and the cost exposure is also very high. Integration in smaller modules at quay site is safer and less dependent on the weather condition, but requires sub-integrations (connections and hook ups among the modules) and commissioning works at height. The availability of quay site facilities is also very limited.

Five common basic types of topside integration methodologies have been used:

Offshore float-over. This operation involves submerging lower hull using ballast water at a pre-selected offshore location with sufficient water depth. When in position and ready to receive the topside, a heavy-lift barge carrying the topside is towed and maneuvered into position for the lower hull to be de-ballasted and mated with the topside. This is an intricate operation and highly dependent on the weather condition. It requires a large logistic support including heavy-lift transportation barges, offshore tugs, supply vessels, AHTs and a team of very experienced crew with specially trained skills. The cost of an offshore float-over operation is very high.

Use of offshore heavy lift vessel. This operation involves the use of an offshore heavy lift vessel which is basically a crane on a floating vessel (barge). The lower hull is usually brought to installation location either by dry or wet tow. The lower hull is first positioned at its final position. The topside is then lifted by the offshore heavy lift vessel and placed onto the lower hull. Depending on the total weight of the topside and the lift vessel's capacity, the integration of the topside to the hull may be done in one of the following manners:

If the lift capacity of a single lift vessel exceeds the weight of the whole topside, the whole topside is lifted by the single lift vessel and placed onto the lower hull.

If the weight of the whole topside exceeds the capacity of a single lift vessel, the topside is built and brought to the installation site in modules and each module is lifted using the single lift vessel. This operation requires connecting and hooking up the modules on site. The process takes a longer time than one single lift. Heavy lift vessels are usually hired at a fixed day rate; therefore, longer installation time means high cost.

If the weight of the whole topside exceeds the capacity of a single lift vessel, the whole topside is lifted by two or more lift vessels at the same time and placed onto the lower hull. The operation is very intricate and requires very large logistic support. The cost of this operation is also very high.

Other disadvantages of using offshore vessel lift vessels relate to the requirement that the lifting points be built into the topside structure. Also, due to limited heavy lift vessels in the world, vessels need to be pre-booked in advance, which makes the scheduling of the installation even more difficult in addition to the weather condition. Offshore lifting may be further limited by crane outreach and vessel stability, resulting in the lift vessels' maximum lifting capacity not being fully used and more lift vessels may be needed for the installation.

Integration using heave lift device at quay site. During the integration, heavy lift devices are usually huge cranes that stand on ground while the lower hull floats in water by the lift device. Depending on the weight and size of the topside, the heavy lift device can either make it in one lift or the topside has to be brought in several modules. The single lift is largely limited by the crane's outreach capacity and weight.

Integration on land with use of strand jacks. This method of integration requires a large open space with strong load bearing ground. The location requires a launching capacity. The construction of the topside and lower hull is done in the same location in pre-determined positions. Generally, the lower hull is assembled around the topside to minimize skidding distance. When all components are complete, the topside is raised off the ground with the use of strand jacks and the lower hull skidded underneath of the topside deck. Once in position, the deck is lowered to complete the integration. This method of integration requires a good load bearing ground and large land space since both the topside and the hull have to be constructed in the same location.

The use of specialty vessels. At the moment, there are several specialty vessels in construction in various parts of the world. They all have varying operation philosophy as compared to the heavy lift vessels. These specialty vessels all require certain level of offshore logistic support and are weather dependent while carrying out the installation offshore. Some of these vessels may have restriction on the footprint size of the deck, lift height and weight.

One common disadvantage of the above integration methodologies is that the weight of the mass structure is supported by a small/limited number of lift points. Each lift bears a very large load, which would result in high stress on the structure in an area around the lift point and strong structural reinforcement is needed to avoid damage during the lifting operation. If one of the lift points fails during the operation, the load it bears would transfer to other lift points. Because of the small number of lift points, the percentage of the load increase on the remaining lift points would be very significant and may cause another lift point to fail. The load on the remaining lift points would further increase, resulting in a chain reaction: all the lift points would fail one after another and the structure being lift would eventually fall causing a serious accident. To avoid the chain reaction, the lift points must be reinforced with very large safety margin. The cables/ropes used to lift the structure must also be chosen with a large safety margin. This means an inefficient use of the structural materials and high costs.

Integration with single lift using one single lift vessel/device in a protected area certainly has many advantages over multi-lift integration, especially because it requires a shorter time and simpler operation, and has lower probability of failure. As oil and gas exploration and production goes to deeper and deeper water and desired production rate increases, the weight and size of the topside of a rig (new-build or conversion) for deep water will significantly increase. The topside of such rig may weigh up to 24,000 tons or higher. Today, the largest offshore lift vessel in the world has a lift capacity of 14,000 tons (Meerema Thialf). The capacity of the largest existing heavy lift device for quay site integration available from Kiewit Offshore Services located at Ingleside, Tex. is 13,000 tons. At present, no single lift integration is possible to lift topside weighing more than 14,000 tons with the existing heavy lift vessel or device. New heavy lift device/systems with much larger lifting capacity are needed for single lift integrations. Building the new lift vessels/devices by simply scaling up the existing ones would not be economical because the size and weight of the new build would dramatically increase and require a larger operation space and a dramatically larger logistic support. Besides, building such a giant lift device itself is a challenge and very costly. Such larger lift vessels/devices would also be much more difficult to mobilize.

SUMMARY OF THE INVENTION

Accordingly, it is an objective of the present invention to provide a heavy lift system with lift capacity larger than the largest capacity of the existing heavy lift vessels/devices for topside integration for offshore rigs.

It is another object of the present invention to provide a single heavy lift system with high mobility and ease of assembling that can be erected on site on land or offshore.

It is a further objective of the present invention to provide a single heavy lift system whose lifting capacity can be increased relatively easy.

It is yet another object of the present invention to provide a method of assembling a floating structure using a single lift system capable of handling significant mass of a topside of the floating structure.

The objectives of the present invention are achieved through a provision of a heavy lift system comprised of modular units, each of which comprises a pair of supporting legs and a transverse beam secured to the legs through jackup device that allow the beam to be moved up and down along the legs. The heavy lift system is transported and erected on site where the heavy lifting task is to be performed, such a dry dock or an offshore location, for instance where the topside is to be combined with the hull of a floating structure.

The legs are positioned adjacent the hull and the topside is suspended from the transverse beams. With the transverse beams of each modular unit moving in unison, the topside is moved to rest on the hull, after which a topside attachment process can begin.

BRIEF DESCRIPTION OF THE DRAWINGS

For a further understanding of the nature and objectives of the present invention, reference should be made to the following detailed description of the preferred embodiments thereof, taken in conjunction with accompanying drawings, in which like parts are given reference numerals and wherein.

DETAIL DESCRIPTION OF THE INVENTION

Figure 1:
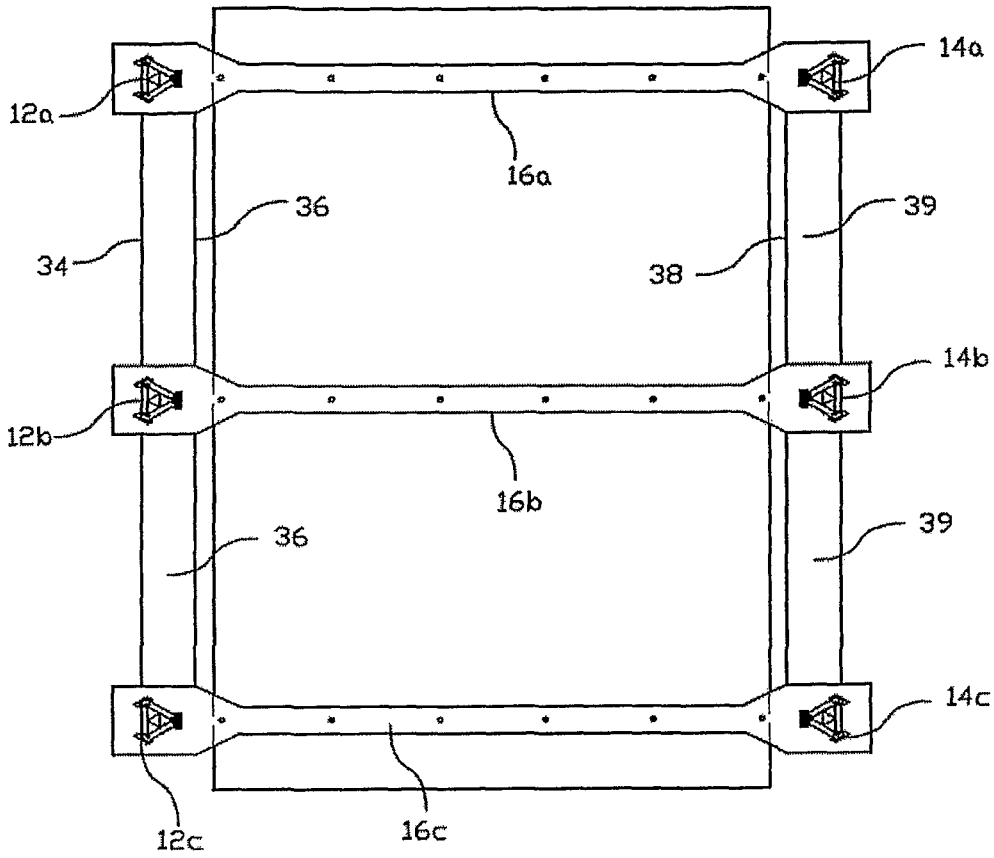
FIG. 1 is a schematic top view of the heavy lift system of the present invention.

In the following description, numerous details are set forth to provide an understanding of the present invention. However, it will be understood by those skilled in the art that the present invention may be practiced without these details and that numerous variations or modifications from the described embodiments may be possible.

In this description, an exemplary weight of the topside is assumed to be approximately 15,000 metric tons. This weight is presented for illustration purposes only, and it will be understood that the system of the present invention can be used for other topside weights, as well. It should be also noted that in this description, the following groups of words are used interchangeably: "system" and "structure"; "vessel" and "barge"; "platform" and "rig"; "horizontal beam," "suspension beam", and "crane beam"; "legs," "supporting legs" and "jackup legs"; "jacking device," "jacking system" and "jacking mechanism"; "fabricate," "manufacture," "construct," and "build"; "fabrication" and "construction"; "modular units" and "modules."

As can be seen in the drawings, the lift system of the present invention is designated by numeral 10. The lift system comprises one or more modular units, each of which comprises a pair of opposing spaced-apart supporting legs 12 and 14. A suspension beam 16 is supported by the legs 12 and 14. The horizontal beam 16 can be a box beam or a truss beam, depending on a particular application.

A jacking device 18 is secured at an end 20 of the horizontal beam 16, and a second jacking device 22 is secured to an end 24 of the beam 16. The jacking devices 18, 22 facilitate movement of the beam 16 vertically along the legs 12 and 14. A platform's topside 30 (or any other heavy lift article) is suspended from the beam 16 by suitable suspension means 32, which can be a wire rope and the like. When more than one modular unit is used, a plurality of connecting beams 34, 36, 38, and 39 connect the modular units and ensure that the system works in a synchronized manner.

Figure 2:
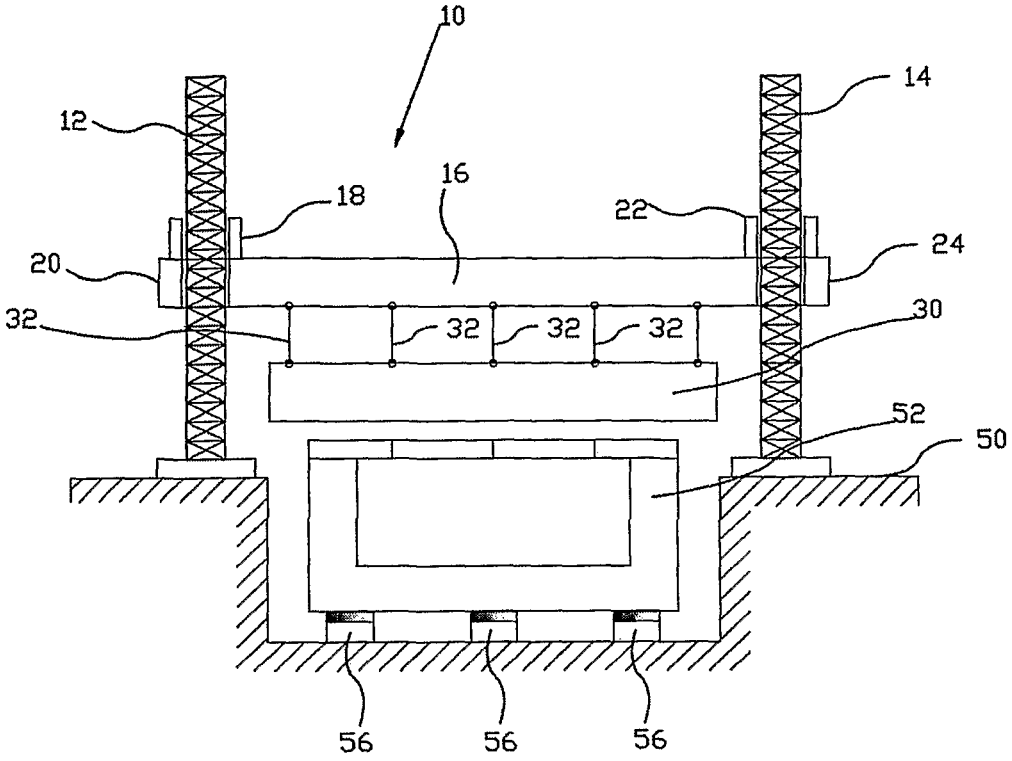
FIG. 2 is a schematic side view of the heavy lift system of the present invention used in a dry dock, with the hull supported by skid supports from the bottom of the dry dock.

One example of use of the lift system 10 is shown in FIG. 2, wherein the legs 12 and 14 are positioned on opposing sides of a dry dock 50. In this example, both topside 30 and hull 52 are fabricated in the dry dock 50, with the topside 30 right below the crane beams 16. When both of them are ready for integration, the topside 30 is lifted first to about a desired height by using the jacking systems 18, 22 and moving the beam 16 up or down to accommodate the size of the topside 30. Then the hull 52 is skidded on the skids 56 to the position right under and aligned with the topside 30. Finally, the topside 30 is lowered onto the top of the hull 52 using the jacking devices 18, 22 and integrated with the hull 52. The dry dock 50 is then flooded and the rig floats. The integrated rig can then be floated out of the dock 50 and transported to the offshore site.

Figure 3:
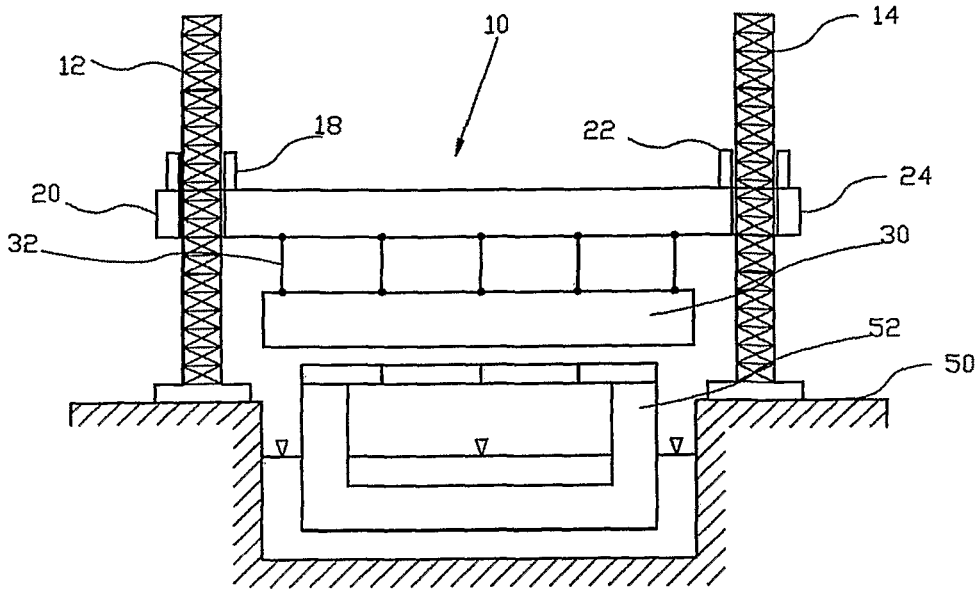
FIG. 3 is a schematic view of the heavy lift system of the present invention illustrating the use of the system in a dry dock, with the hull being buoyantly positioned in the dry dock.

FIG. 3 illustrates another application scenario in which the topside is fabricated in the dry dock 50 right under the lift system 10. The hull 52 is either fabricated in the same dry dock 50 or in a different location. In case of both the topside 30 and the hull 52 being fabricated in the same dry dock 50, when both are ready, the topside 30 is lifted up to the desired height using the jacking devices 18, 22. Then the dry dock 50 is flooded so that the hull 52 can be floated to the position under and aligned with the topside 30. The topside 30 is then lowered onto the top of the hull 52 and integrated with the hull 52.

In case of the hull 52 being fabricated in a different location, the hull must be first transported from its construction site and waits outside the dry dock 50. When both are ready for integration, the topside 30 is lifted to the desired height using the jacking devices 18, 22 that move the suspension beam 16 up and down, as required. Then the dry dock 50 is flooded and the gate of the dock is open to allow the hull 52 to float in. After the hull 52 is brought to the position aligned with the topside 30, the topside is lowered onto the top of the hull 52 and integrated with the hull 52. Finally, the integrated structure is floated out of the dock 50 and transported to the offshore site.

In the above case illustrated in FIG. 3, the topside 30 can also be fabricated in another place and floated into the dock 50, where it is lifted by the lift system 10. Then the hull 52 is brought in. The rest of the integration procedure is the same as the one described above.

Figure 4:
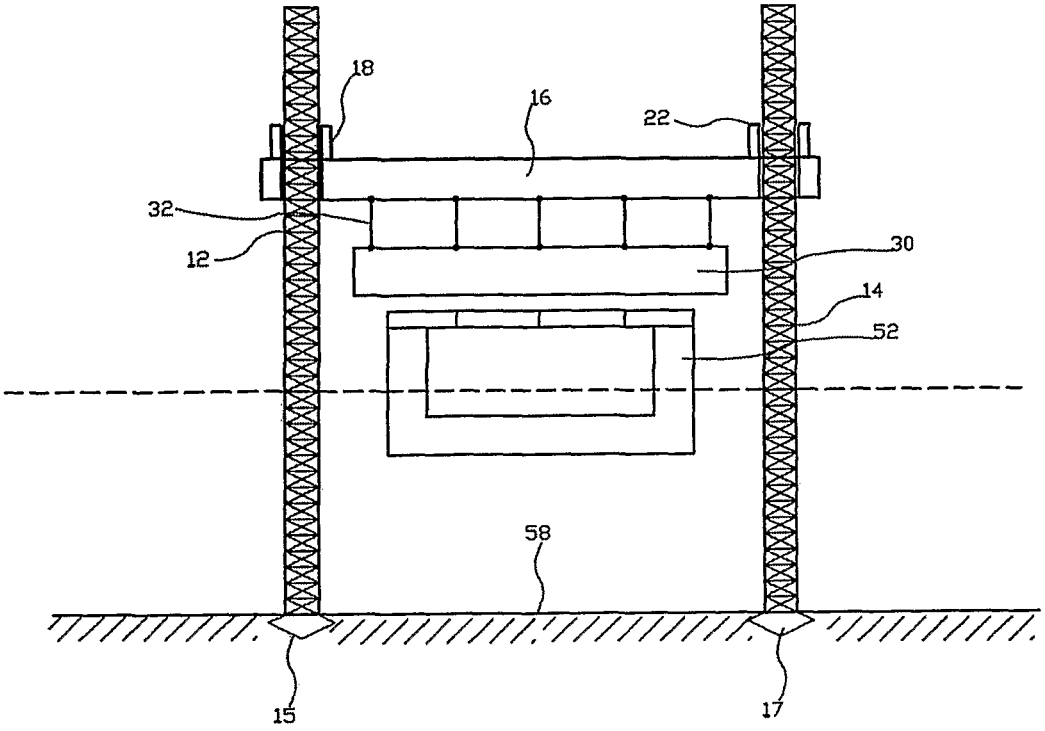
FIG. 4 is a schematic view of the heavy lift system of the present invention used in an offshore location, with the legs supported by embedded footings from the sea bottom.

FIG. 4 illustrates the use of the system of the present invention for integration in open water. The lift system stands on its legs 12, 14, which carry footings (such as spudcans 15, 17) on the sea bottom 58. The topside 30 is towed on a barge (not shown) into a position under the crane beams 16. The topside 30 is lifted to the desired height using the beam 16, which is elevated by the jacking devices 18, 22. The transport vessel, such as the barge, is moved away. Then the hull 52 is towed into a position under and aligned with the topside 30. The hull 52, being a buoyant body, floats in open water. The topside 30 is then lowered by the suspension beam 16 and the suspension means 32 onto the top of the hull 52 and integrated with the hull. The integrated structure is ready to be transported to the offshore site.

Figure 5:
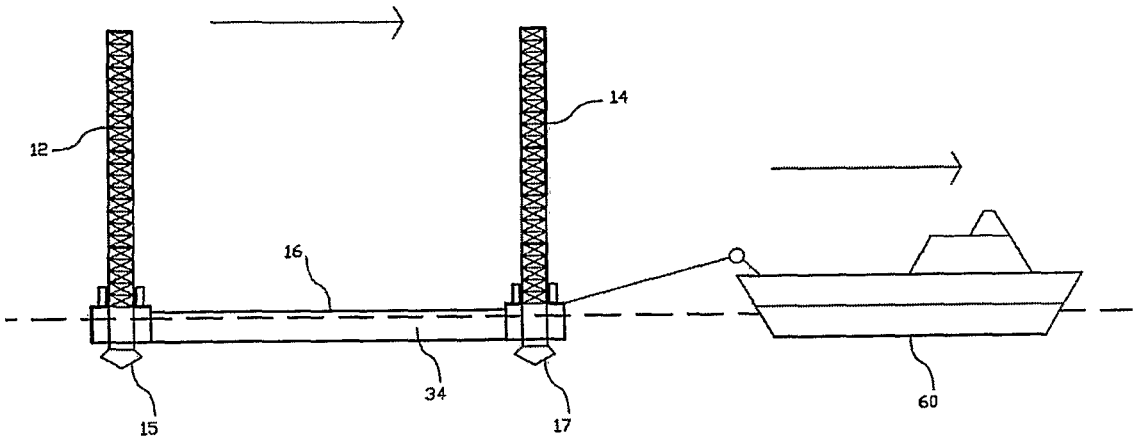
FIG. 5 is a side view schematically illustrating the lift system being transported (towed) as a whole, with the beams providing the necessary buoyancy in the open waters.
Figure 6:
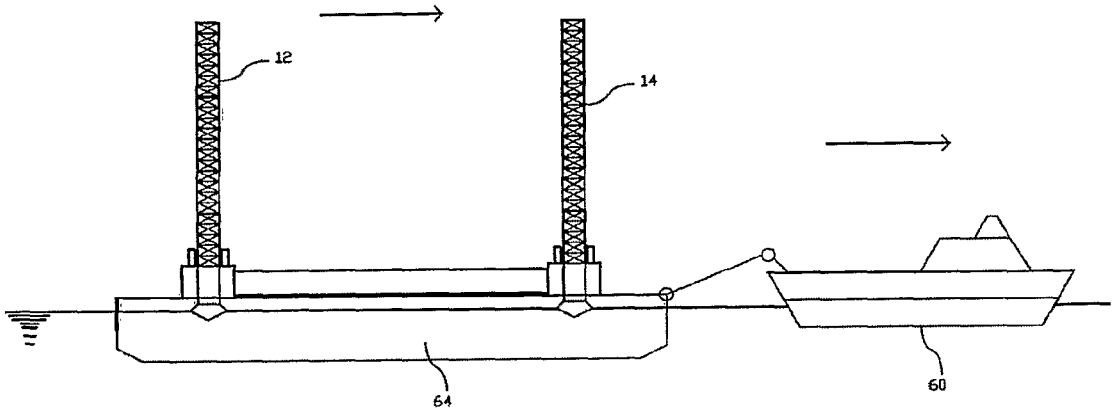
FIG. 6 is a side view schematically illustrating the lift system of the present invention being transported as a whole on a barge and towed.

The heavy lift system 10 can be transported to a location as a whole or in pieces. FIG. 5 illustrates a case, in which the lift system 10 is transported (towed) as a whole using a towing vessel 60. In this case, the system 10 floats on the crane beams 16 and the connecting beams 34, 36, 38 and 39 which are built as water-tight box structures to provide sufficient buoyancy. For faster and longer-distance transportation of the system, the whole system may be placed on a large barge 64 and towed by a towing vessel 60, as schematically illustrated in FIG. 6. Alternatively, the whole system can be transported by a self-propelled transportation vessel. Upper portions of the legs may be dissembled and placed on the transportation vessel to remain a proper stability.

Figure 7:
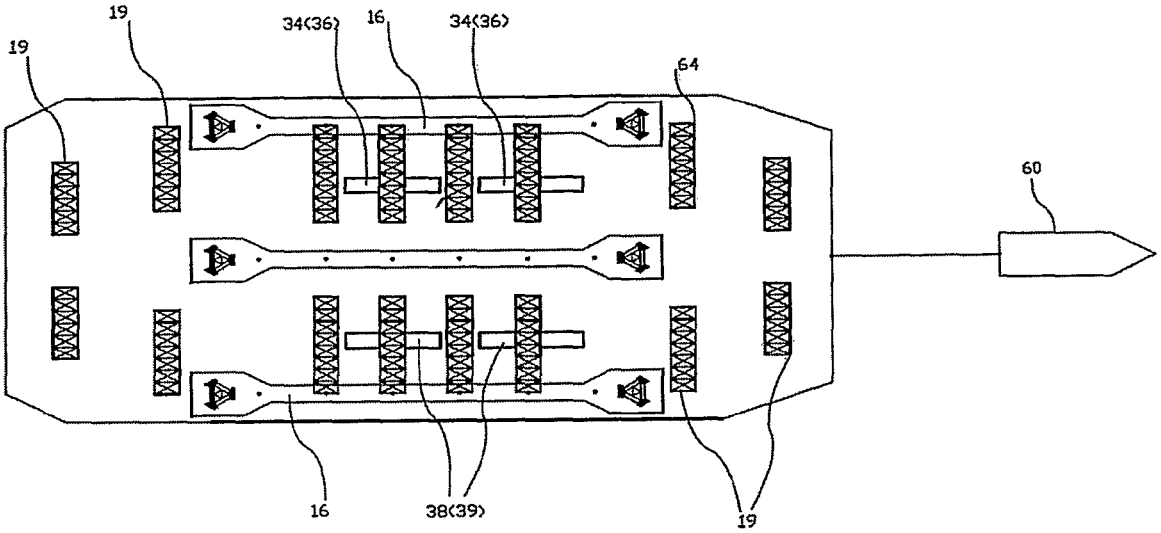
FIG. 7 is a top view of the system of the present invention disassembled into a plurality of modular units including suspension beams, connecting beams and the legs positioned on a barge and towed.

FIG. 7 schematically illustrates another example of transporting the system 10 to a job site. In this example, the system 10 is disassembled into a plurality of separate elements of a modular unit. As can be seen in the drawing, the suspension beams 16, connecting beams 34, 36, 38 and 39, and the separate leg modules 19 are placed on a barge 64 and towed by a towing vessel 60. To reduce cost and save time, the jacking systems 18, 22 and lower portions of the leg modules 19 can remain engaged with the suspension beams 16.

Figure 8:
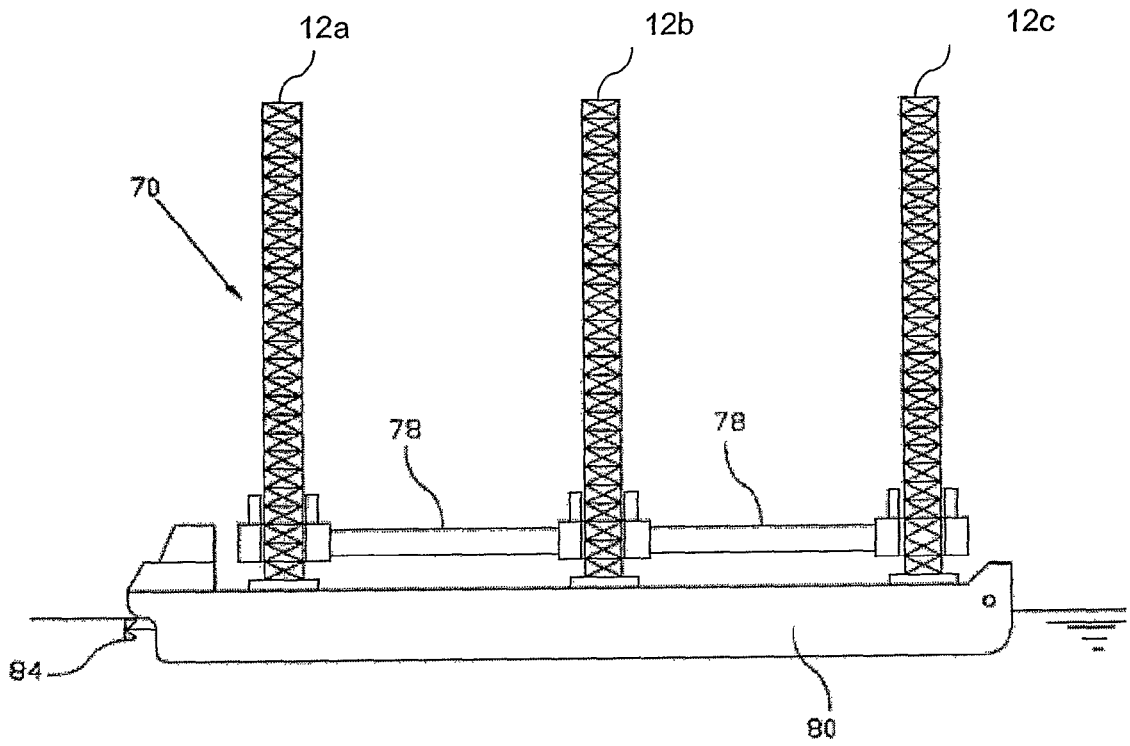
FIG. 8 is a schematic view of the system of the present invention constructed as a self-propelled vessel.

Still another example of the system of the present invention is illustrated in FIG. 8, wherein the system 10 is manufactured as a self-propelled heavy lift system 70. The system 70, composed of connected modular units similar to the system 10, stand on two huge floaters 80 (simple shaped barges or pontoons, or ship-shaped vessels with relatively low resistance for long distance transportation). The floaters 80 are each equipped with a propulsion system 84 so that the whole heavy lift system 70 can relocate to a job site using its own transportation means.

The jacking systems or devices 18, 22 used in the heavy lift system of this invention are well adapted to handling large loads; they can lift up to 20,000 tons, and it is relatively easy to increase the lift capacity without significant increase in cost and difficulty. Many jackup manufacturers, such as those yards of Keppel O&M, have already the ability to build larger jacking systems.

One of the particular advantages of the present invention is the use of modular structure concept for the single heavy lift system. The modular structure allows the system to be transported in modules to different locations and easily assembled them at a job site. The modular structure also allows easy change of the system's lift capacity by simply increasing or decreasing the number of modular units in the system.

The legs 12, 14 can stand on each side of a dry dock, or a wet bed, or a floating dock and support the beam 16 at the two ends. The beam is equipped with a jacking mechanism/system on each of its ends. The jacking system is similar to those of a jackup rig. The beam is supported by the legs through the jacking systems and can be moved up and down by the jacking systems. Two or more major modular units can be connected side by side using the supplemental modular units to form a single heavy lift system of a desired lifting capacity. A heavy structure, such as topside, attached/tied to the horizontal beams can be lifted by jacking up the beams. The system of the present invention may be built for use on land or offshore depending on where the integration will be conducted.

The space between the major modular units and the locations of the holding points where the suspension means 32 are secured to the beams 16 can be adjusted to accommodate particular topside for optimal load distribution so that the lifting capacity can be used as closely as possible to the fullest extent. Additional modular unit can be added to increase the lift capacity if needed.

The mobility of the heavy lift system 10 can be achieved in many ways:

If the horizontal beams 16 are made such that they can provide sufficient buoyancy to support the whole system, the whole system can be towed to different locations. The beams and legs can be transported separately and assembled at site. The beams may be towed (if buoyant) or transported on a barge. The legs can be transported on a barge. The beams and legs can further be made into smaller modules. These smaller modules are transported to the desired location and assembled at site. Transportation in smaller modules allows use of smaller transportation vessels, especially for land transportation in case there is no special road for heavy vehicles and heave cranes available.

The heavy lift system 10 of the present invention can also include a movable base on which the legs of the system stand on the moveable base so that the whole lift system can move on a horizontal plane. The movable base can be carts with wheels which can move along track rails on a solid foundation, or a floating dock or barges, even vessels with propulsion systems similar to those illustrated in FIG. 8. The movable base allows a greater flexibility in use of the system. It also allows a greater flexibility in laying out the fabrication of the topside and hull, as well as other components of a rig. It can also make topside installation simpler and easier.

The heavy lift system of this invention has the following advantages but not limited to these:

Integration operation can be carried out during all seasons of the year with no weather window to follow, except in raw extreme conditions such hurricanes and strong storms;

Operation can be carried out in yard vicinity thus eliminating expensive mobilization cost of any logistical resources to support the operation;

Rig components can be constructed in different location giving flexibility and choice of construction location;

There are no outreach limitations as the system lifts the entire topside over and above the lower hull;

No expensive and relatively heavy ballasting operation on the lower hull is needed as the system will lift deck up to 300 ft overhead.

The heavy lift system 10 of the present invention also has a larger flexibility in choosing the number of the lift points and their locations along the suspension beams (16). The number of lift points of the system 10 can be significantly larger than those of existing lift devices and their locations can be optimized so that the reinforcement can be kept to a minimal or even unnecessary. A large number of the lift points would also significantly reduce the chance of chain-reaction type of failure and therefore require a smaller safety margin. This would imply a significant saving in the materials and construction cost.

The system of this invention is relatively smaller in size and weight compared to conventional heavy lift systems; thus lower cost, as compared to traditional swinging types of cranes for a same lifting capacity.

While the illustrative embodiments of the invention have been described with specific details, it is understood that various modifications can be readily made by those skilled in the art without departing from the spirit and scope of the invention. Accordingly, the scope of the claims appended hereto is not limited to the description provided herein but encompasses all the patentable features of the present invention, including all features which would be treated as equivalents thereof by those skilled in the art to which this invention pertains.

We claim:

1. A heavy lift system for lifting large mass structures, comprising:

a plurality of modular units each of the modular units comprising a pair of spaced apart supporting legs, a transverse beam having opposing ends, each end being engageable to one of said supporting legs in a substantially transverse relationship to longitudinal axes of said supporting legs, a means carried by said transverse beam for engaging in suspension a large mass structure; and a means for moving said transverse beam up and down along said supporting legs, thereby moving said large mass structure engaged to said transverse beam, wherein the plurality of modular units are capable of moving the transverse beam of each of the modular units in unison to lift said large mass structure engaged to the transverse beam of each modular unit; and wherein the transverse beams of said plurality of modular units are held in a substantially parallel relationship by connecting beams that extend between and are secured to the transverse beams.

2. The system of claim 1, wherein said means for moving said transverse beam comprises a jackup device secured between an end of said transverse beam and an adjacent supporting leg, said jackup device supporting the end of the transverse beam on the adjacent supporting leg.

3. The system of claim 1, wherein said system is configured with a pre-determined lifting capability, which is made adjustable by selective use of the number of modular units forming the heavy lift system.

4. The system of claim 1, wherein said means for engaging in suspension comprises a plurality of lifting members spaced along the length of the transverse beam.

5. The system of claim 1, wherein said supporting legs are configured for positioning on land.

6. The system of claim 1, wherein said system is a self-propelled heavy lift system.

7. The system of claim 1, wherein said system is a mobile heavy lift system configured for transportation on land.

8. The system of claim 1, wherein said system is a mobile heavy lift system configured for transportation on water.

9. The system of claim 1, wherein said system is configured for positioning on a floating structure.

10. The system of claim 1, wherein said system is configured for positioning on a floor of a body of water.

11. The system of claim 1, wherein said supporting legs are formed of a plurality of leg modules capable of being assembled on site into supporting legs.

12. A method of assembling a floating structure having a hull and a topside, comprising the steps of:

providing a heavy lift apparatus comprising a plurality of modular units comprised of a pair of spaced apart supporting legs, a transverse beam with opposing ends, each end being engageable to one of said supporting legs, and a means for moving said transverse beam up and down along said supporting legs, wherein the plurality of modular units are capable of moving the transverse beams of the modular units in unison; and wherein the transverse beams of said plurality of modular units are held in a substantially parallel relationship by connecting beams that extend between and are secured to the transverse beams;

positioning said heavy lift apparatus adjacent said hull;

suspending the topside from said transverse beams in unison, while aligning said topside with the floatable hull;

moving the transverse beams in unison along the corresponding supporting legs and positioning the topside on said floatable hull for engaging said topside to said hull.

13. The method of claim 12, wherein said hull is positioned in a dry dock and retained therein without flotation while the topside is being positioned on said hull.

14. The method of claim 12, wherein hull is positioned in a dry dock and retained in a floating positioned while the topside is being positioned on said hull.

15. The method of claim 12, wherein each of said legs is configured for resting on a floor of a body of water.

16. The method of claim 12, wherein said heavy lift apparatus is configured as a self-propelled unit.

17. The method of claim 12, wherein said heavy lift apparatus is configured for transportation on land and/or water.

18. The method of claim 12, wherein said means for moving said transverse beam is a jack device positioned between an end of the transverse beam and a respective supporting leg, said jackup device facilitating movement of the transverse beam along said supporting legs.

19. The method of claim 12, further comprising a step of providing the transverse beam with a plurality of spaced-apart suspension means for suspending the topside.

20. The system of claim 8, wherein the transverse beam of at least one modular unit is built as a water-tight box structure to provide sufficient buoyancy.

21. The system of claim 8, wherein the transverse beams of the modular units are connected by connecting means, at least one connecting means is built as a water-tight box structure to provide sufficient buoyancy.

22. A heavy lift system for lifting large mass structure, comprising:

A plurality of modular units each comprising a pair of spaced apart supporting legs, a transverse beam having opposing ends, each end being engageable to one of said supporting legs in a substantially transverse relationship to longitudinal axes of said supporting legs, a means carried by said transverse beam for engaging in suspension a large mass structure; and a means for moving said transverse beam up and down along said supporting legs, thereby moving said large mass structure engaged to said transverse beam, wherein the transverse beam of each of the modular units is built as a water-tight box structure to provide sufficient buoyancy; and wherein the transverse beams of said plurality of modular units are held in a substantially parallel relationship by connecting beams that extend between and are secured to the transverse beams.

* * * * *